United States Patent [19]

Austin et al.

[11] 4,416,737

[45] Nov. 22, 1983

[54] PROCESS OF ELECTROPLATING A NICKEL-ZINC ALLOY ON STEEL STRIP

[75] Inventors: Lowell W. Austin, Weirton, W. Va.; James O. Stoddart, Clinton, Pa.

[73] Assignee: National Steel Corporation, Pittsburgh, Pa.

[21] Appl. No.: 347,704

[22] Filed: Feb. 11, 1982

[51] Int. Cl.[3] ..... C25D 3/56; C25D 7/00

[52] U.S. Cl. ..... 204/28; 204/27; 204/43 T; 204/DIG. 13

[58] Field of Search ..... 204/43 T, 43 Z, 27, 204/28, DIG. 13

[56] References Cited

U.S. PATENT DOCUMENTS

| | | | |
|---|---|---|---|
| 2,419,231 | 4/1947 | Schantz | 204/43 Z X |
| 2,840,517 | 6/1958 | Faust et al. | 204/43 T |
| 2,844,530 | 7/1958 | Wesley et al. | 204/43 T X |
| 4,249,999 | 2/1981 | Tsuda et al. | 204/28 |
| 4,251,329 | 2/1981 | Asano et al. | 204/27 |
| 4,268,364 | 5/1981 | Hall | 204/43 Z |
| 4,282,073 | 8/1981 | Hirt et al. | 204/28 |
| 4,313,802 | 2/1982 | Shibuya et al. | 204/28 |

OTHER PUBLICATIONS

J. K. Dennis et al., "Nickel and Chromium Plating", pp. 140–142, (1972).

*Primary Examiner*—G. L. Kaplan

*Attorney, Agent, or Firm*—O'Neil and Bean

[57] ABSTRACT

An electroplating process is disclosed for coating metal strip or sheet with a nickel-zinc alloy comprising at least 80% nickel. Steel sheet coated with the alloy exhibits excellent weldability.

9 Claims, 1 Drawing Figure

PERCENT Zn IN DEPOSIT vs. ROTATION RATE
(CURRENT DENSITY = 75 A/ft$^2$)

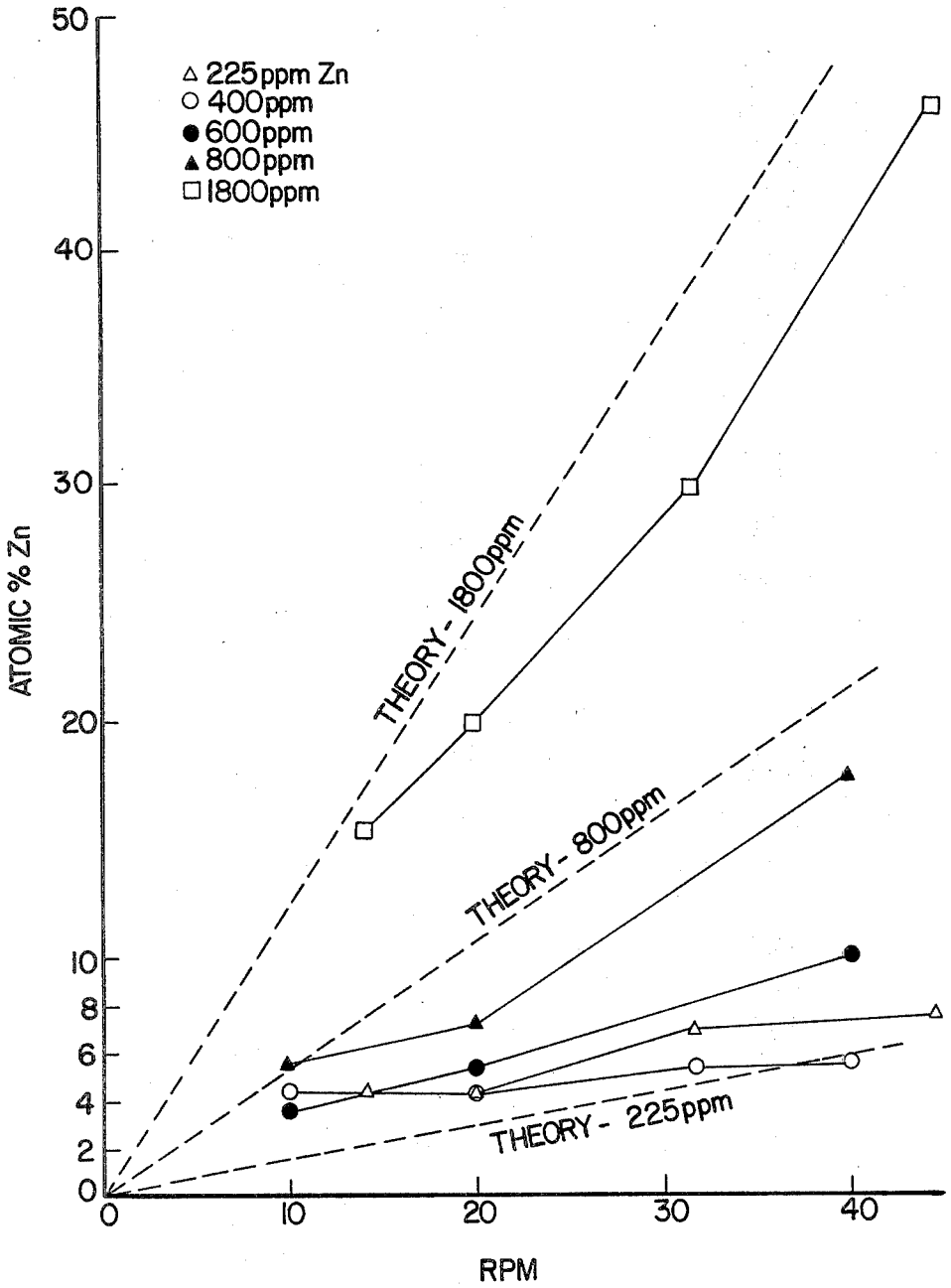
PERCENT Zn IN DEPOSIT vs. ROTATION RATE
(CURRENT DENSITY = 75 A/ft$^2$)

PROCESS OF ELECTROPLATING A NICKEL-ZINC ALLOY ON STEEL STRIP

FIELD OF THE INVENTION

The invention is directed to high nickel content alloys produced by electrodeposition and to an improved electrodeposition process for the production of said alloys. The nickel alloys contain nickel and less than 20 weight percent zinc. The alloys are provided as coatings on metal substrates such as sheet steel.

BACKGROUND OF THE INVENTION

Plated sheet steel is well known and widely used for various applications particularly where corrosion resistance is an important consideration or where severe working as in a deep drawing or drawing and ironing operation is required. For such uses in the past, tin has been the most common coating metal and tinplate has been widely used particularly in the production of cans for food, beverages, and the like. The use of chromium-plated steel is also widely used in the production of cans, and galvanized steel and nickel-plated steel have also been used for various purposes. It has also been proposed to include minor amounts of zinc in a nickel plating bath to produce a brighter finish for nickel-plated articles and it is known to include small amounts of nickel in a zinc plating bath.

SUMMARY OF THE INVENTION

The invention is directed to the production of high nickel content alloys by electrodeposition. Generally, the alloys contain at least 80% nickel and up to 20% zinc, but preferably the alloys contain at least about 90% nickel and up to about 10% zinc. The alloys of the invention are produced by electroplating onto a steel substrate from a nickel salt-boric acid electrolyte containing at least about 40 ppm zinc at temperatures ranging from about 120° to 160° F.

The steel products of the invention are steel plate or sheet of the type suitable for the production of containers or cans, for example, and coated with the nickel-zinc alloy. The coated steel sheet exhibits excellent corrosion resistance and workability. Moreover, steel sheets coated with the alloy exhibit excellent weldability, that is, steel coated with the alloy of the invention exhibits excellent bonding to itself. In fabrication of seamed containers, the alloy coated on steel provides an excellent seam when formed by wire-mesh welding processes without requiring edge stripping or brushing.

DESCRIPTION OF THE DRAWING

FIG. 1 is a graph in which the zinc content of the alloys is plotted against the rotation rate of a rotating disk electrode in an electroplating solution used in the process of the invention.

DETALED DESCRIPTION OF THE DRAWING

Alloys of the invention contain generally at least 80% nickel and up to 20% zinc. The grain structure of the alloys was studied by electron miscroscopy. None of the diffraction patterns showed any evidence of free zinc. Specimens of the alloy exhibited remarkable uniformity. Generally, the microstructure consisted of fine grains with little texture. Grain diameters were generally less than 33 Å having some internal structure with only highly localized preferred orientation and overall random orientation. Very little porosity was detected.

At higher magnifications some of the grains appear to exhibit internal structure; however, even at the highest available manification, little detail could be picked out. The structure appears to be a mixture of dislocation tangles and twinning. The estimated grain size of an alloy containing 5.45% zinc produced on a pilot line run was somewhat finer, ranging from about 190 to about 210 Å mean grain diameter.

Electron diffraction patterns indicated no consistent overall preferred orientation of the deposit, although small regions exhibited local preferred orientation that varied from region to region. At times, the coating took on a striated appearance, sometimes with well defined boundaries, but more often with no obvious boundaries.

Another feature revealed by the electron miscroscope study was the appearance of angular etch pits resulting, apparently, from the coating replicating etch pits in the underlying steel. Usually these pits occurred in clusters having the same orientation but whose orientation varied from one cluster to another. The rectangular flat bottom shape of the pits suggests that the pits have walls and bottom and reflect the orientation of the underlying steel.

Another reflection of substrate structure is the apparent replication of fine-grained patches noted in a photomicrograph made at 16,000 X in which one white grain which measured 4 cm across was actually 2.5 microns across (0.0001), corresponding to ASTM grain size 14. In the photomicrograph the etch pits were roughly hexagonal, again implying walls and that the steel grains have a plane parallel to the surface.

Often associated with the "fine grain" patches were long, dark regions which sometimes contained internal structure. Such a dark structural component, compared to the rest of the field, is much thicker than the rest of the structure. Sharp boundaries indicated a sudden change in thickness. The dark material may be either a wall standing up from the coating or a ditch or crack in the steel. Examination of a number of such dark regions indicates that they are walls or dykes standing up from the surface.

On the whole, the coatings were remarkably free of pores or perforations. Occasionally a string of pinholes would be seen, or clusters of pinholes would be detected. Whether these "pinholes" are a sideproduct of alloy production or a result of electrolytic stripping and specimen processing is unknown. In a few cases a small pinhole, roughly the same size and shape of the pinhole, can be seen next to the pinhole, implying that pinhole was present in the coating but was dislodged during specimen preparation.

The process of the invention for making the alloys includes producing them electrolytically from an electroplating solution on a steel substrate. The electroplating solution is acidic with a pH of about 3 to about 5 and contains a source of soluble nickel and at least about 40 ppm of zinc in, for example, a soluble salt form. Typically, the source of nickel will be nickel sulfate and nickel chloride, as nickel sulfate is a relatively inexpensive source of nickel ions; the chloride ion provided in the form of nickel chloride allows proper anode corrosion. The plating solution thus will contain:

Nickel sulfate ($NiSO_4.7\ H_2O$): 60 to 90 g/l

Nickel chloride ($NiCl_2.6\ H_2O$): 60 to 90 g/l

Nickel equivalent as metal (total nickel content): 25 to 45 g/l

Boric acid ($H_3BO_3$): 30 to 50 g/l pH: 3 to 5

Zinc (provided as $ZnSO_4.1\ H_2O$): 40 ppm to 1800 ppm

Generally, the zinc is present in amounts less than 1800 ppm, as at that concentration, the deposit is dark uniformly at effectively low agitation rates, while at relatively higher agitation rates, the deposit is dark with streaks. Preferably, the zinc concentration is less than about 1000 ppm. Most preferably, the zinc concentration ranges from about 50 ppm to about 400 ppm.

The electroplating solution is maintained at a temperature of about 120° to about 160° F., cathode and anode current densities can range from about 50 to about 150 A/ft$^2$ and preferably are about 100 A/ft$^2$. The electroplating solution may be agitated as required. In pilot and mill line plating assemblies, as opposed to batch processes, the effect of line speeds can be correlated to agitation. It has been discovered that at zinc concentrations of up to about 400 ppm in the electroplating solution, the alloy deposit composition is substantially independent of line speeds or agitation and generally results in an alloy containing zinc in an amount ranging from about 4 weight percent up to about less than 9 weight percent, with the remainder being substantially nickel; and usually, the alloy contains from about 5 to about 7 weight percent zinc. At zinc concentrations equal to or greater than about 600 ppm, line speeds or agitation do affect the alloy composition in that increase in line speed or agitation results in increased zinc content of the alloy. Accordingly, greater uniformity of alloy compositions is obtained in continuous plating lines at zinc concentrations of between 40 and 400 ppm in the electroplating solution.

Steel substrates coated with alloys of the invention can be used in fabricating containers, and are particularly useful in the production of cans of the type commonly employed in the packaging of foods and beverages. The steel substrate is one which has a tendency to corrode and can be backplate strip or sheet. The alloy coat on the substrate may be of a thickness ranging from 0.5 to 5.0 microinches and preferably about 1 to 3 microinches for use in can production. Testing shows that backplate plated in accordance with the invention possesses satisfactory corrosion resistance for use as a commercial carbonated beverage can or for other uses where the conventional tin-plated can is now employed. Samples of such steel strip or sheet, coated by an alloy electroplated in accordance with the invention, were subjected to the Salt Fog, to the Humidity Cabinet, and Stack Pack tests. In the Salt Fog test, samples were exposed to a 5 weight percent salt fog 94° F. for two hours. In the Humidity Cabinet test, samples were exposed to 96% relative humidity at 96° F. for one week. In the Stack Pack test, sheets were wrapped in paper and then tightly pressed between fiberboards with steel bands to form stackpacks which were placed in a humidity cabinet for one month under the same conditions as in the Humidity Cabinet tests. These tests were conducted on samples which had been subjected to conventional chromate or dichromate treatment and then lacquercoated with a commercially available vinyl or epoxy coating conventionally used with beverage cans.

In addition to providing corrosion resistance, the excellent workability of these alloys coated on steel sheet allow for the production of drawn, drawn and redrawn, drawn and ironed and seamed containers. Moreover, the alloy coated on sheet steel provides an excellent seam, when formed by wiremash welding techniques.

The following examples present specific embodiments of the invention by way of illustration.

EXAMPLE 1

A number of coils of 80 lb. base weight continuous cast steel strip were continuously annealed to a T-4 temper. The strip was then plated in accordance with the invention in a five day run on a modified horizontal halogen tin plating line in which nickel anodes replaced the tin anodes and a nickel plating solution replaced the halogen tin plating solution. The analysis of the nickel plating bath over the five day run is set out in table (a)

TABLE (a)

| Day* | Nickel (g/l) | Boric Acid (g/l) | Chloride (g/l) | Sulfate (g/l) | Zinc (ppm) | Iron (ppm)** |
|---|---|---|---|---|---|---|
| 1 | 38.9 | 22.4 | 31.6 | 21.9 | 41.2 | ND |
| 2 | 41.6 | 24.2 | 33.4 | 23.8 | 40.6 | 65 |
| 3 | 43.2 | 36.2 | 34.0 | ND | 152 | 180 |
| 4 | 35.6 | 32.0 | 28.1 | 18.7 | 99 | 226 |
| 5 | 39.0 | 36.4 | 30.7 | 22.1 | 133 | 272 |

**No iron was detected on Day 1.

The bath was maintained at a pH of about 3.6 and a temperature of about 140° throughout the five day run.

The coils were plated on the bottom side using four plating cells with 1500–1600 amps per cell. On a second deck, the top was plated and was run through four plating cells with applying current. Under these conditions, the thickness of the plated coating was 1.5 microinch, and the coating had a zinc content of 12%.

After plating, the strip was rinsed to remove plating solution and, without applying current, was passed through a vertical chemical treatment tank maintained at 120° F. and containing 40 g/l chromic acid 0.2 g/l sulfate 0.5 g/l silico fluoride.

The treatment resulted in a film of 230 micrograms/ft$^2$ of chromium oxide.

Thereafter, the coils were rinsed with demineralized water, dried, and electrostatically oiled with ATBC at a level of 0.40 gm/base box and recoiled. A number of the coils were then used to form cans.

Certain steel coils plated during this run were treated in Example 5 to provide specimens for electron microscopy studies discussed above.

Various observations were made during the run, during which the line speed was about 1000 fpm although rates of 1500 fpm were approached. Generally, the electrical conductivity of the bath was very good; low operating voltages of about 5 volts were required. At zinc concentrations of about 100 ppm in the bath, the zinc content of the coating could be maintained at about 5 to about 7 weight percent. As can be seen from the preceding analyses, the iron content of the bath increased during the run.

EXAMPLE 2

For this run, two additional cells on each deck of the line were activated for a total of six cells up and six cells down. Line speeds were increased and many coils were plated at 1500 fpm; on the last day of the run, the line speed was increased to 1850 fpm. Analysis of the nickel plating bath during the six-day run is set forth in Table (b).

TABLE (b)

| Day* | Nickel (g/l) | Boric Acid (g/l) | Chloride (g/l) | Sulfate (g/l) | Zinc (ppm) | Tin (ppm) |
|---|---|---|---|---|---|---|
| 1 | 38.2 | 41.4 | 34.5 | 23.7 | 135.3 | |
| 2 | 44.2 | 42.0 | 36.11 | 24.5 | 106.7 | |
| 3 | 43.2 | 41.0 | 36.11 | 25.9 | 100.0 | |
| 4 | 38.2 | 37.8 | 31.3 | 22.0 | 103.5 | 315 |
| 5 | 30.4 | 29.0 | 25.7 | 19.5 | 93.5 | 245 |
| 6 | 32.6 | 31.8 | 26.5 | 16.5 | 94.0 | 56 |

*Temperatures were maintained at 140° F.

In this run, hydrogen peroxide was added at the end of each day to the plating solution to oxidize the iron contaminant and to precipitate it, and then the plating solution was filtered to remove the iron precipitate. The results of this treatment are tabulated in Table (c).

TABLE (c)*

| Day | | Nickel (g/l) | Fe (ppm) | pH |
|---|---|---|---|---|
| 3 | | 42.4 | 15 | 3.4 |
| 4, | 10 a.m. | 40.3 | 32 | 3.5 |
| | noon | 37.5 | 70 | 3.6 |
| | 2 p.m. | 31.2 | 85 | 3.75 |
| 5, | 10 a.m. | 33.3 | 25 | 3.8 |
| | | | 45 | 3.95 |
| | | | 63 | 4.0 |
| | noon | 35.3 | 70 | 3.95 |
| | | | 76 | 4.0 |
| | 2 p.m. | | 95 | 4.0 |
| | | | 100 | 4.0 |
| 6, | 8 a.m. | 37.5 | 22 | 3.8 |
| | 10 a.m. | 38.4 | | |
| | 11 a.m. | 35.8 | 45 | 3.9 |
| | noon | 31.7 | 95 | 3.9 |
| | 1 p.m. | 32.5 | 100 | 4.1 |
| | 2 p.m. | | 122 | 4.2 |
| | 3 p.m. | | 138 | 4.25 |
| 7, | 9 a.m. | 34.3 | 15.0 | 3.9 |
| | 10 a.m. | | 15.0 | 4.0 |
| | 11 a.m. | | 43 | 4.05 |
| | noon | | 58 | 3.85 |

*These results were determined on site, while the results of Table (b) were analyzed at a quality control lab.

The results of iron precipitation indicated that the concentration of iron contaminant could be reduced and maintained within desired limits.

As can be seen from Table (b), there was a drop-off in nickel concentration which was due to overnight losses in electrolyte. At the relatively higher line speeds of about 1500 ppm in this run (with the highest line speed of 1850 fpm at the end of the run), compared to the run of Example 1, it was noted that plating solution levels of zinc of about 95 ppm to about 100 ppm resulted in coatings containing about 8 percent zinc. The total current applied during this run ranged from 10,400 to 19,200 amps. An attempt was made to maintain the current density at about 100 asf at the higher line speeds used in this run, and plating efficiency ranged from 88% to 90% based on the theoretical current requirement for the nickel and zinc metal plated. No attempt was made to calculate current required to plate small amounts of iron and other impurities from the bath.

EXAMPLE 3

This run was conducted on equipment which was substantially identical to that used in the preceding example. Zinc content of the plated deposit could be controlled to be 10%, preferably 9% or less, at very high line speeds. The line speed during the first two days of the run was 1500 fpm; it was raised to 1600, then to 1750, and approached 1900 fpm on the last day. During the run, electrolyte was siphoned from the main plating system to a plastic reaction vessel where the electrolyte was treated with hydrogen peroxide.

Using these conditions, the zinc content of the plated deposit was 9% or less; and most of the coatings contained about 7 to 8 weight percent zince, when an electroplating solution of the following compositions was used:

TABLE (d)

| | Solution Analysis | | | | | | |
|---|---|---|---|---|---|---|---|
| Day | Nickel (g/l) | Boric Acid (g/l) | Chloride (g/l) | Sulfate (g/l) | Zinc (ppm) | Tin (ppm) | Iron (ppm) |
| 2* | 34.8 | 33.2 | 27.3 | 21.7 | 141 | 236 | 145 |
| 3** | 34.6 | 34/4 | 26.9 | 22.5 | 126 | 112 | 107 |

*Line speed of 1500 fpm and temperature of 140° F.
**Line speed of about 1650 fpm and temperature of about 140° F.

A series of independent tests was undertaken to determine the amounts of hydrogen peroxide which would be required to substantially reduce the iron ($Fe^{++}$) content of the nickel plating bath. It was determined that the addition of 0.5 ml of hydrogen peroxide to a liter of a Watts nickel bath containing 117 mg/l iron would reduce the iron to 16 mg/l. It was also determined that at a pH of 3.7, more iron was contained in the bath than at the 4.2 pH.

EXAMPLE 4

The effects of electrolyte agitation and zinc concentration on the composition of electrodeposited nickel-zinc alloys were investigated with a rotating disk electrode (RDE). The well-defined flow patterns obtained at the RDE allowed the effects of electrolytic agitation to be studied in a quantitative manner.

The experimental conditions for these experiments included an electrolyte of the follow composition:

Nickel sulfate ($NiSO_4.7\ H_2O$): 89.4 g/l
Nickel chloride ($NiCl_2.6\ H_2O$): 81.0 g/l
Boric acid: 50 g/l
Zinc sulfate ($ZnSo_4.1\ H_2O$): 0 ti 7.9 g/l The bath temperature was maintained at 135° F. The metal substrate which was electroplated was in each instance a ⅝-inch black-plate disk in a 1(one)-inch diameter epoxy disk holder. The substrate was degreased in trichloroethylene, pickled in 5% (volume) $H_2SO_4$ at 160° F. (pickling being eliminated in the last samples) and rinsed before immersion into the bath. The metal substrate and holder were supported, specifically inserted, in the bottom of the RDE. The RDE is manufactured by Pine Manufacturing Co., Grove City, Pa. The RDE was disposed in the bath (a beaker containing the electrolyte) between a platinum anode and a calomel reference electrode. The disks were plated at a constant current of 80 mA/cm$^2$ (74.3 A/ft$^2$) for five seconds after desired RPM had been reached. The resulting deposit was stripped in 25% nitric acid and submitted for analysis by atomic absorption.

TABLE (e)

| RPM | Atomic % Zn in Deposit | Appearance |
|---|---|---|
| Zn = 225 ppm | | |
| 200 | 4.34 | |
| 400 | 4.40 | |
| 1000 | 7.18 | |

TABLE (e)-continued

| RPM | | Atomic % Zn in Deposit | Appearance |
|---|---|---|---|
| 2000 | | 7.73 | faint streaks |
| 2000 | | 7.61 | faint streaks |
| | Zn = 400 ppm | | |
| 100 | | 4.02 | |
| 100 | | 4.80 | |
| 400 | | 4.40 | |
| 1000 | | 5.45 | faint streaks |
| 1600 | | 6.08 | faint streaks |
| 1600 | | 5.37 | faint streaks |
| | Zn = 600 ppm | | |
| 100 | | 3.56 | |
| 400 | | 5.11 | |
| 400 | | 5.65 | |
| 1600 | | 10.5 | dark and streaked |
| | Zn = 800 ppm | | |
| 100 | | 5.60 | |
| 400 | | 6.66 | |
| 1600 | | 17.9 | dark and blotched |
| | Zn = 1800 ppm | | |
| 200 | | 15.4 | uniformly dark |
| 400 | | 20.0 | uniformly dark |
| 1000 | | 29.7 | dark with streaks |
| 2000 | | 46.4 | dark with streaks |

The results of a number of experiments in which the zinc concentration and the stirring rate were varied are summarized in Table (e). For most of the samples, appearance was noted and the trend was for darker, more streaked deposits at higher rotation rates and higher zinc levels.

As can be seen from Table (e) and FIG. 1, at low zinc concentrations (up to 400 ppm); a relatively constant alloy composition of about 6% (atom) was attained regardless of rotation rate.

By comparison, at higher zinc concentrations in the electrolyte plating solution, specifically at zinc concentrations greater than 600 ppm, the concentration of zinc in the deposit shows a strong dependence on the rotation rate (in Table (e) and FIG. 1) which is similar to that dependence which may be predicted from theory. The theory of the RDE predicts that the mass transport of zinc by convective diffusion to the RDE surface varies linearly with the square root of the rotation speed. In FIG. 1, the chemical composition of the plated alloys is plotted (results of duplicate runs were averaged) against the square root of rotation speed for various zinc levels in the plating bath. As to zinc concentrations in the electrolyte plating solutions greater than 400 ppm, the zinc content of the deposit does increase with increasing rotation speeds, and at these concentrations, convective diffusion of zinc appears to be rate-limiting. According to theoretical curves based on the theory of the RDE, the composition of the alloy should be controlled by the approximation: weight % $0.9\times$atomic %.

The effect of the rotation rate of an RDE on alloy composition may be correlated with line speeds through a plating cell with higher rotation rates corresponding to higher line speeds. The correlation may be made by the theoretical methods outlined in paragraphs A and B.

However, the convective diffusion rate varies with the square root of the line speed and with the inverse square root of distance into the plating bath. Accordingly, under conditions controlled by convective diffusion where the latter parameter (the inverse square root of distance into the bath) was not constant, electroplating in accordance with the invention would result in alloy deposits of less uniform composition than those alloys produced under conditions in which convective diffusion was not rate-limiting. Such decrease in uniformity would also result in decrease of reproducibility. Accordingly, agitation in bath processes and line speeds in continuous plating line assemblies and/or zinc plating bath concentrations can be controlled to produce uniform or substantially uniform and reproducible or substantially reproducible alloy coatings.

A. The Rotating Disk Electrode (RDE).

For an RDE under steady laminar flow conditions, the maximum convective diffusion rate to the surface (denoted as the "limiting current" for electrochemical reactions) can be calculated from the Levich equation:

$$i_L=0.62nFC^*D^{\frac{2}{3}}\gamma-1/6\omega^{\frac{1}{2}}$$

where the parameters are defined as follows for zinc ions in a 135° F. nickel bath.

$i_L$=limiting current density in mA/cm$^2$ n=number of electrons in reaction=2 g-eq/g−mol F=Faraday's constant=96500 cou;/g-eg C*=bulk concentration of zinc=0.0038−0.028 g-mol/l (225–1800 ppm)

D=diffusion coefficient=$8.1\times10^{-6}$ cm$^2$/sec $\gamma$=kinematic viscosity=viscosity/density=0.0105 cm$^2$/sec $\omega$=angular velocity in radians/sec=2Π/60 RPM The values for D and $\gamma$ were estimated from published room temperature data:

D=$7.3\times10^{-6}$ cm$^2$/sec at 25° C. (Ref. 4, p. 54)

Assuming linear dependence on absolute temperature, the following relationship can be derived:

$$D_{57^\circ C.}=D_{25^\circ C.}\left(\frac{57+273}{25+273}\right)=8.1\times10^{-6}\ \text{cm}^2/\text{sec.}$$

The value of $\gamma$ was estimated by consideration of the vicosity, $\mu$, and the density, $\rho$, where $=\mu/\rho$.

Extrapolation of tabular data gives $\mu$=1.5 cp at 25° C. and the temperature dependence was estimated from p. 3–247 of Ref. 5 to give $\mu$=1.15 cp=0.0115 g/cm-sec. The value of $\rho$ was taken to be 1.1 g/cm$^3$, thus the value of $\gamma=\mu/\rho$=0.0105 cm$^2$/sec. Substituting the numerical values into the Levich equation, we get $$i_L(\text{mA/cm}^2)=102.9\cdot(C^*)\,(2\Pi/60\ \text{RPM})^{\frac{1}{2}}=33.3\,(C^*)\text{RPM}^{\frac{1}{2}}$$

The corresponding composition of zinc in the deposite can be calcutlated from $$\text{atomic \% zinc}=\frac{i_L\,(100)}{(i_{total})\,(\text{Efficiency})}.$$

The theoretical result for $i_{total}$=80 mA/cm$^2$ and Efficiency=0.95 have been plotted.

Laminar flow at an RDE is expected up to a Reynold's number $(r^2\omega)/\gamma$ of $10^5$. For the experimental setup used here, laminar flow would be anticipated at higher RPM.

The time required for the RDE to reach a steady state after switching on a current is characterized by the transition time $$\tau_d=\delta_d^2/3.1D$$

where $\delta_d$ is the thickness of the diffusion layer for the RDE, given by $$\delta_d = 1.61 D^{\frac{1}{3}} \gamma^{1/6} \omega^{-\frac{1}{2}}$$

thus $\tau_d$ is inversely proportional to $\omega$. At 100 RPM, $\tau_d = 0.87$ sec. and at 1000 RPM, $\tau_d = 0.087$ sec. for the system studied here.

B. The Moving Sheet Electrode

The solution to the convective diffusion equation for a planar electrode moving through an otherwise stagnant bath was published by D. T. Chin, *J Electrochemical Society,* 122, 643 (1975). The limiting current distribution through the bath under convective diffusion control may be calculated from $$i_L = nFkC^*,$$

where $i_L$, n, F, and C* are defined as in Appendix 1 and k is the local mass transfer coefficient which is calculated from Equation in the Chin article:

$$k = 0.5642\left(\frac{D}{X}\right)\left(\frac{\nu x}{\gamma}\right)^{\frac{1}{2}}\left(\frac{\gamma}{D}\right)^{\frac{1}{2}} = 0.5642\left(\frac{\nu D}{x}\right)^{\frac{1}{2}}.$$

For zinc diffusion in a 13507 nickel bath at a concentration of 200 ppm, then $$i_L = (2)\,(96500)\left(0.00306\,\frac{\text{g-mol}}{\text{l}}\right) k = 0.945\left(\frac{\nu}{x}\right)^{\frac{1}{2}} \text{mA/cm}^2$$

Direct comparison of convective diffusion conditions between different geometries, such as the moving strip and the RDE, may be accomplished through the mass transfer coefficients, k, or equivalently, through the diffusion layer thicknesses, $\delta$. (By definition, $k = D/\delta$.) Systems having the same mass transfer coefficients (diffusion layer thicknesses) are equivalent from a mass transport point of view.

From the limiting current distributions calculated as above, an overall (average) mass transport rate may be calculated for a single plating cell by integrating the current distribution over the length (L) of the plating cell. The average rate is a convenient quantity for discussion and comparison of different plating systems. From Equation 23 of the Chin article the overall (average) limiting current for a plating cell is given by $$i_{L,ave} = nFKC^*$$

where $$K = 1.128\left(\frac{D}{L}\right)\left(\frac{\nu L}{\gamma}\right)^{\frac{1}{2}}\left(\frac{\gamma}{D}\right)^{\frac{1}{2}} = 1.128\left(\frac{\nu D}{L}\right)^{\frac{1}{2}}.$$

For a plating section five feet long, the average limiting mass transfer rate for 200 ppm zinc at a strip moving 40 ft/min is:

$$i_{L,ave} =$$

$$2(96500)\,(.00306)\,(1.128)\,\frac{(20.3\text{ cm/sec})\,(8.1\times10^{-6}\text{ cm}^2/\text{sec})^{\frac{1}{2}}}{152.4\text{ cm}} =$$

-continued $$0.69\text{ mA/cm}^2 = 0.64\text{ A/ft}^2$$

and similarly, for 1000 ft/min, $$i_L = 3.16\text{ A/ft}^2.$$

The transition from laminar to turbulent flow would be expected to arise along a moving strip electrode at a Raynolds number $\nu x/\gamma$ of $5\times10^6$ (8). For a strip moving at 1000 ft/min, this would correspond to a distance of $$x = \gamma/\nu(5\times10^6) = 103.3\text{ cm} = 3.4\text{ ft into the cell.}$$

These rough calculations indicate that turbulent flow near a strip moving at speeds ~1000 ft/min is expected in the downstream region of the cell. End effects in the cell would tend to enhance the turbulent flow, and thus enhance the mass transport rates.

It is also noted that during these studies the voltage at the rotating disk was varied linearly at 20 mV/sec and the corresponding current was monitored. The effect of stirring on the current voltage behavior was not significant up to zinc concentrations of about 400 ppm. However, at zinc concentrations of 400 ppm and greater, there is a dramatic shift of 200 mV at 52.3 A/ft$^2$ for an increase in rotation speed from 100 to 2000 RPM. Moreover, it was noted that there was a reversal of the trend for more negative voltages at increased rotation rates when the zinc concentration was increased up to 600 ppm. These results also suggest that a change in the alloy deposition mechanism occurs at higher zinc concentration levels.

EXAMPLE 5

Method of Obtaining Specimens of Coatings Produced in Example for Electron Microscopy and Photographs of the Drawings The specimen is produced by scribing from an alloy-plated coil a piece about one-inch square into 1 mm squares on one side with a scriber having a broad face to produce relatively wide and deep scribe marks and lacquering the other side, and then by making the scribed and lacquered piece the anode in an electrolytic cell.

Although its composition is not critical, the electrolyte is a solution of 5% KI and 5% sodium citrate with a pH of about 5.5. The potassium iodide is used to provide high conductivity and to promote attack. Potassium bromide has also been used effectively but KC1 seems too aggressive. The citrate ions are used to complex iron and to thus prevent hydroxide formation at high pH levels. Sodium citrate is inexpensive and convenient, but other complexing agents will work equally well. A pH range of 5 to 6 in the electrolyte seems to provide optimum attack of the steel and no detectable attack of the nickel coating. As pH levels increase above 6, attack becomes non-uniform, and pitting occurs. At low acid pH, concern arises for attack of the nickel-zinc alloy coating.

A glass crystallizing dish with a diameter of 90 mm and a depth of 50 mm is used to hold the solution. A strip of stainless steel about one-inch wide, cut into a semi-circle, lines the wall of the dish and acts as a cathode.

The scribed and lacquered piece, described above, and the cathode are attached to a low D.C. power source; one corner of the scribed and lacquered piece is dipped into the electrolyte and the power is turned on to develop a current of about 5 mA/mm$^2$. Generally, after ten minutes of electrolysis, loose fragments of the coating can be washed off the square into a shallow dish. The fragments are washed with water to remove any residual salts and then washed with acetone to remove water and prevent corrosion and are picked up on TEM grids. The individual fragments are slowly lowered into a water bath where surface tension of the water will "snap out" a curled fragment so that it will float flat on the surface of the water. By sweeping the grid up through the water underneath the fragment, the fragment can be picked up and will remain flat. After toweling the edge of the grid with a paper towel to draw off water, the specimen, the fragment of coating, is ready for examination in the TEM. Specimens were produced from samples of alloys plated on coils in Example 1 having the following coating compositions:

| Coating Weight | | Composition |
|---|---|---|
| Ni | Zn | % Zn |
| 26.4 mg/ft$^2$ | 5.65 | 18.3 |
| 29.3 | 2.77 | 8.65 |
| 26.7 | 2.62 | 8.94 |
| 25.9 | 1.50 | 5.45 |

While specific embodiments of the invention have been disclosed and described, it is understood that the invention is not restricted solely thereto, but rather is intended to include all embodiments thereof which would be apparent to one skilled in the art and which come within the spirit and scope of the invention.

What is claimed is:

1. A process for electroplating a protective nickel-zinc alloy coating on metal strip or sheet which has a tendency to corrode wherein said nickel-zinc alloy coating consists essentially of at least 80 percent nickel and up to 20 percent zinc, said process comprises:

providing an aqueous plating solution consisting essentially of dissolved nickel, in an amount ranging from about 25 to 45 g/l, and dissolved zinc, in an amount of at least 40 ppm, wherein the iron content of the plating bath is maintained at less than 100 ppm, maintaining said plating bath at a pH of about 3 to about 5 and an elevated temperature of up to about 160° F.; and immersing said metal strip or sheet in said plating bath and subjecting it to a cathodic plating current density of from about 50 to about 150 amperes/ft$^2$, to electroplate a protective nickel alloy coating.

2. The process of claim 1, wherein the plating bath contains zinc in a concentration of at least about 600 ppm and wherein the zinc content of the nickel coating is dependent on the degree of agitation in the plating bath.

3. The process of claim 1 wherein electroplating is conducted in a continuous plating line assembly; and wherein the zinc content of the nickel coating is dependent on the rate at which the metal strip or sheet is passed through the bath and on the distance through which the metal sheet or strip has traveled into the bath.

4. The process of claim 1, wherein the amount of zinc is less than 600 ppm.

5. The process of claim 1, wherein said metal substrate is subjected to said cathodic current density until the coating is about 0.5 to about 5.0 microinch in thickness.

6. The process of claim 1, wherein the concentration of zinc ranges from about 40 to about 400 ppm, and wherein the zinc content of the nickel alloy coating is substantially independent of agitation in the plating bath.

7. The process of claim 1, wherein the concentration of zinc ranges from about 80 to 150 ppm.

8. The process of claim 1, wherein the nickel coating is free of free metallic zinc detectable by electron microscope.

9. The process of claim 1, wherein iron is precipitated from the bath by the addition of hydrogen peroxide and removed by filtering.

* * * * *